United States Patent [19]

Paul et al.

[11] 4,314,679

[45] Feb. 9, 1982

[54] ROLL HOLDER AND DISPENSER

[76] Inventors: Dennis J. Paul; Lloyd J. Speedy, both of Devonport, New Zealand

[21] Appl. No.: 83,153

[22] Filed: Oct. 9, 1979

[30] Foreign Application Priority Data

Oct. 12, 1979 [NZ] New Zealand ..... 188643

[51] Int. Cl.[3] ..... B65H 19/04

[52] U.S. Cl. ..... 242/55.3

[58] Field of Search ..... 242/55.3, 55.53, 55.42; 312/37–39, 41

[56] References Cited

U.S. PATENT DOCUMENTS

| | | | |
|---|---|---|---|
| 2,307,944 | 1/1943 | Clemens | 312/39 |
| 2,839,346 | 6/1958 | Lawalin | 312/39 |
| 2,872,264 | 2/1959 | Nehring | 312/39 |
| 3,284,014 | 11/1966 | Wiggins et al. | 242/55.53 |
| 3,484,052 | 12/1969 | Clarke | 242/55.42 |
| 3,754,719 | 8/1973 | Choy | 242/55.3 |
| 3,770,222 | 11/1973 | Jespersen | 242/55.3 |
| 4,034,924 | 7/1977 | Carlisle | 242/55.3 |

*Primary Examiner*—Leonard D. Christian

[57] ABSTRACT

A roll holder and dispenser for rolls of webbed material (11) such as used for toilet paper or towels comprising a container (10) having a first aperture (24) where rolls are inserted and a second aperture (28) from where a web of roll material can be withdrawn. The container (10) is made relatively theft proof by an inwardly angled flange (26). The flange (26) is situated near the first aperture (24), and allows a roll to be inserted but makes it difficult for a roll to be withdrawn. Near the second aperture (28) there is a second flange (30) used for separating the upper stored rolls from the bottom usable roll. A side aperture (32) is situated in a side wall (20) or (22) at the same level as the flange (30). When it is desired to pull a roll down from the storage position it is only necessary to insert a finger or thumb through the aperture (32) and engage the center core of the roll and pull it downward passed the flange (30) to the usable position at the bottom end (14) of the container (10). By having the usable roll resting on the bottom end (14) there is sufficient friction provided to allow a user to easily remove the webbed material while at the same time making it difficult to extract material in excessive lengths.

1 Claim, 4 Drawing Figures

ROLL HOLDER AND DISPENSER

Priority Claim

This application claims priority of an earlier application Ser. No. 188643, filed Oct. 12, 1978 in New Zealand.

TECHNICAL FIELD

This invention relates to a holder and dispenser for rolls of webbed material as used for toilet paper or towels.

Background Art

Toilets and particularly public toilets are generally supplied with toilet paper in the form of single rolls attached to a device for preventing the removal of the roll while permitting paper to be removed for use. Such devices come in various forms but generally suffer from the disadvantages of either the paper being difficult to remove from the roll or that it is very easy for a person to spin the roll and use more paper than is necessary. Maintenance has also been a problem in that once the single roll of paper has been used, the roll must be replaced to allow continued normal use of the toilet. Additionally, the pilfering of rolls in public buildings constitutes a costly problem and disrupts maintenance schedules.

Disclosure of Invention

The present invention consists of a roll holder and dispenser comprising a container having two ends with an aperture through which a roll of webbed material can be inserted into the container, and at a adjacent one end a second, smaller aperture through which a web of material can be withdrawn from the roll. The container having near the one end an impeding means for impeding the passage of a roll within the container towards the one end; and a releasing means whereby a roll can be pushed towards the one end against the urging of the impeding means. The invention allows a user to easily remove the webbed paper from the roll and in quantities that are not excessive. Provisions are also included to allow spare rolls to be safely stored within the container so that when a roll is emptied the used roll is discarded and a stored roll can be easily placed in position for use. The invention provides a container with a relatively long maintenance period, reduces pilfering, is convenient to use and thus, is cost effective.

BEST MODE FOR CARRYING OUT THE INVENTION

Figure 1:
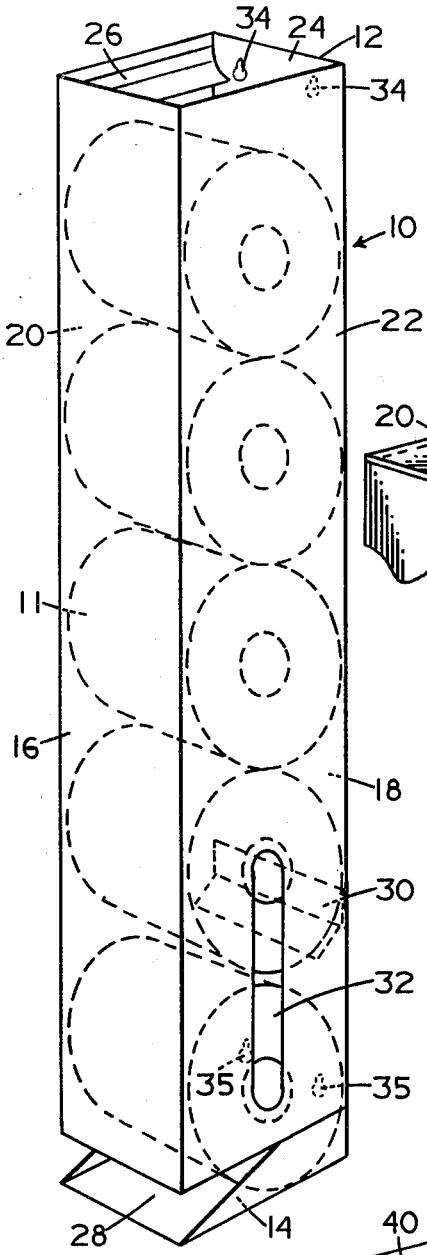
FIG. 1 is a perspective view of the preferred embodiment of the roll holder and dispenser.
Figure 2:
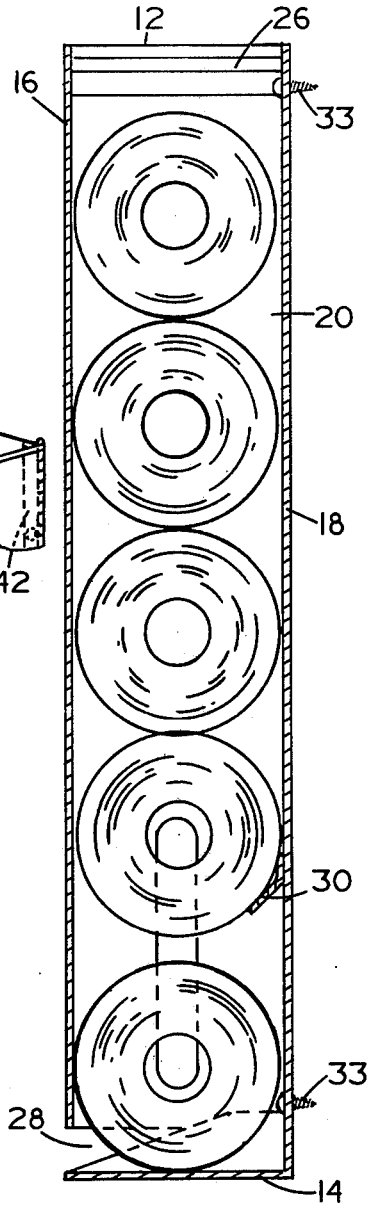
FIG. 2 is a sectional view of the preferred roll holder and dispenser.

The best mode or preferred embodiment for carrying out the invention is depicted in FIGS. 1 and 2. The figures show a container 10 comprising a top end 12, a bottom end 14, a front wall 16, a rear wall 18, a left side wall 20, and a right side wall 22. The container 10 is open at the top end 12 providing a first aperture 24 through which rolls can be inserted and stored within the container 10. Slightly below the top end 12 is a first flange 26 angled inwardly at one side so that a roll can be inserted into the aperture 24 by pushing it in past the flange 26, but the angle of the flange 26 being such that the roll cannot be withdrawn. In other words, the aperture 26 provides a one-way passage into the container 10, preventing unauthorized withdrawal of a roll from the container 10.

Near the bottom end 14 of the container 10 is a smaller second aperture 28 extending across the bottom end 14 of the front wall 16 and continuing part way along each side wall 20 and 22. The aperture 28 is just large enough that an empty core or roll can be withdrawn through the aperture 28. A short distance above the aperture 28 is situated a second flange 30 for impeding the progress of a roll. Thus, when a roll is inserted through the first aperture 24, it falls down until it reaches the flange 30 where the roll is held up between the flange 30 and the front wall 16. Any further rolls inserted through the first aperture 24 will rest on top of this standby roll.

Alternatively, rather than a flange 30, the front wall 16 or rear wall 18 may be kinked slightly inwardly, substantially all the way across its width, so that when a roll is inserted through the first aperture 24, it falls down until is reaches the kink where the standby roll is held up between the kink and the opposite wall.

A side aperture 32 is situated in a side wall 20 or 22 at the same level as the kink or flange 30. The side aperture 32 is typically elongate, being parallel to the edges of the side wall, and centrally located in the side wall so that it is aligned with the core of the standby roll held between the kink or flange 30 and the opposite wall.

When it is desired to pull the standby roll down to be accessible through the second aperture 28, it is only necessary to insert a finger or thumb through the aperture 28 to engage the center core of the roll and push it downwardly past the kink or flange 30. Once the roll has passed the kink or flange 30 it will fall to the bottom of the container 10 where the web of the roll will be accessible to be withdrawn through the second aperture 28.

As much web as is required can then be withdrawn from the roll through the aperture 28, but it will be impossible to flick the roll to set the roll rotating to dispense an inordinately large amount of web. The roll will simply be resting on the bottom of the container 10 and not on any freely rotatable spindle, and so friction prevents any free spinning of the roll. The required length of the web can be torn off either at perforations in the web or against either the top or bottom horizontal edge of the aperture 28.

The container 10 is attached to a wall typically by means of screws through upper screw holes 34 and lower screw holes 35 where both sets of screw holes are located in the rear wall 18. Small apertures can be located in the front wall 16 opposite the screw holes through which a long screwdriver can be inserted to provide access to the screws. In the preferred embodiment, however, the screw holes are near the top 12 and bottom 14 of the rear wall 18, and since the container is open at the top 12 and at second aperture 28 there is reasonable access provided to the screws without the necessity of having small apertures in the front wall 16.

The width of each side wall 20 and 22 of the container 10 is slightly greater than the width of the roll for which the container 10 is intended to be made. The width of the front wall 16 is slightly greater than the length of the intended roll.

The present invention is thus ideally suited for use as a toilet roll dispenser in public toilets. A large stack of toilet rolls can be stored within the container 10 so that as one roll is used up, the next in the standby stack can be brought down for use. The toilet paper is readily accessible but does not lend itself to being withdrawn in excessive quantities. It is also difficult for any person to remove the rolls of paper which are in storage and not yet in use. A full roll cannot be withdrawn through the second aperture 28 since that aperture is only large enough to permit an empty core or roll, not a whole roll, to pass through.

The invention can also be used in other applications, such as for paper towels in an office or a public wash room.

Many modifications to the above are possible within the scope of the present invention as broadly defined. Some of the other embodiments related to the preferred embodiment follow:

At the top end 12 of one of the side walls 20 and 22 there may be a circular aperture through which a roll can be inserted into the container 10. When the container 10 is attached to the wall, the aperture is preferably on the left hand side of a person facing the container 10 so that it is relatively difficult for a right handed person to insert his hand into the aperture and down into the interior of the container to remove a roll. Also, the fact that the aperture is only slightly larger than the roll for which the container 10 is intended, would make it difficult for any person to grab a roll with his hand and then withdraw it through the aperture. An alternative form of top opening is an aperture situated near the top on front wall 16. The front wall 16 opening being particularly pertinent when the container 10 is recessed into a wall.

The roll obstruction at the lower end of the container 10 could, instead of being a kink or flange 30 in the front or rear wall, be a ledge or other protrusion extending inwardly from either wall. Alternatively the obstruction may be in a side wall of the container 10 with the "side aperture 32" being in the front wall 16, and the second aperture 28 also extending right across a side wall (so that the rolls are held sideways in the container 10).

Alternatively the obstruction may comprise a flap extending into the interior of the container 10 but movable to one side against the urging of a spring or other biasing means, or upon operation of a handle on the outside of the container 10.

The container 10 may be of any desired length so that any number of rolls can be stored in the container 10, and any suitable gap can be left between the top roll and the first aperture 24 to inhibit removal of stored rolls.

Figure 3:
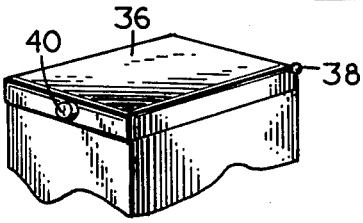
FIG. 3 is a view which shows an embodiment of the roll holder and dispenser with a hinged lid on the top end of container.

One embodiment of the present invention can be provided with a lid 36 as shown in FIG. 3, rather than a theft-proof first aperture 24. The lid would be held by simple hinge pins 38 and could have a knob 40 to facilitate opening the lig 36. The knob 40 could also include a locking device if desired. The lid 36 may also be flat as shown in FIG. 3 or may be sloping to prevent cigarette butts from being placed on top of the lid 36. Alternatively, an ashtray may be built into the top of the lid 36.

The container 10 may be provided near the top end 12, bottom end 14, or on one side, or at any position, with an additional compartment into which smelling salts or deodorant can be placed. This may be particularly useful for example where the container 10 is used as a toilet roll holder in a toilet.

At the bottom end 14 the container 10 may comprise a base, the inner surface of which is textured or roughened to create friction with the web material of the roll to impede withdrawal of the web so that it cannot be pulled out too quickly, resulting in possible wastage of the web material. The rough surface may be provided by the material of the container 10 itself being roughened, or by a rough veneer being placed onto the surface of the base.

The second aperture 28 may be provided with a serrated edge to facilitate the cutting of the roll web. This may be particularly useful for applications where the container 10 holds rolls of paper towel material which is not perforated at regular intervals. Either the upper or the lower edge, or both edges, of the aperture 28, may be serrated.

At the inner rear wall 18 of the container 10 there may be situated a curved plate, the curve comprising substantially a quarter turn having substantially the radius of a full roll of the material for which the container 10 is proposed to be used. The purpose of the curved plate is to prevent a roll from coming to rest at the rear of the container 10 once a piece of web has been withdrawn from it, thus rendering it difficult to reach to withdraw a further length of web. If the roll has any tendency to move back and forth along the base of the container the curved plate will cause it to come to rest nearer the front where it is more easily reached.

The container 10 can also have one or more inspection holes at its front or side to enable it to be determined readily at a glance how many rolls remain in the container 10.

Figure 4:
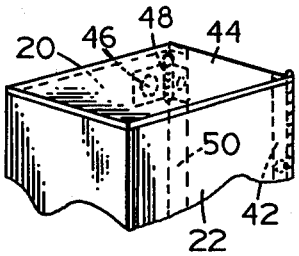
FIG. 4 is a view which shows an embodiment of the roll holder and dispenser with a cover on the top end of container and a hinge on one of side walls.

If the container 10 lacks a rear wall 18, or if the rear wall 18 does not extend for the full length of the container 10, the wall against which the container 10 is positioned serves as the back. The container 10 in this configuration, as shown in FIG. 4, incorporates a hinge 42 situated on side wall 20 or 22 or alternatively at the back side of bottom end 14. The container 10 being retained at the other side or end by a lockable device 46 so that the container 10 can swing away from the wall to reveal the open back which includes an inward retaining flange 50 to hold the rolls in place. The container 10 can then be loaded in the open position and then swung back against the wall and locked in position to prevent the removal of any rolls except by withdrawing web through the second aperture 28. In this case the container 10 need not have a loading first aperature 24 at its top end 12 but can be completely closed by a cover 48 when locked shut.

Alternatively the container 10 may have a lockable door which opens at the front wall 16 or either side walls 20 or 22 to enable the container 10 to be loaded. The door may extend along the full length of the container 10 or alternatively may be only large enough to insert one roll at a time. The door can be anywhere between these two extremes in size.

The bottom end 14 itself may be able to be swung open or locked closed. When the bottom is open the rolls can be fed into the container 10 through the open bottom 14.

In one embodiment the aperture at the bottom end 14 through which the web material can be withdrawn may be vertical, the container 10 being arranged so that the rolls are held vertically within it so that when web material is withdrawn from a roll the roll rotates about a vertical axis.

Alternatively, the container 10 may be arranged to hold rolls side by side, rather than one on top of another. In this case, there is preferably a slot extending the entire length of the container 10 for propelling the rolls sideways towards the end which is provided with the withdrawal aperture. The slot is preferably, although not necessarily, along the underside of the container 10. Other means, such as compression springs, may be used, however, for urging the rolls towards the appropriate end.

In an alternative arrangement, the container 10 may be provided with an inner sleeve which is spring loaded within the outer housing. The inner sleeve may be lockably retained within the housing or released, the arrangement being such that when the sleeve is released, it can be withdrawn against the spring bias far enough to enable rolls to be loaded into the container 10.

In another form of the invention an aperture may be near the top end of the container 10, the rolls being stored in the lower position of the container 10 but being able to be pushed up one at a time past a hinged flap upon which the top roll rests to be accessible through the aperture. The hinged flap is able to be swung upwardly but not downwardly from its normal, horizontal position. A slot may be provided at the side of the container 10, running substantially the full length of the container 10, to enable the topmost roll in the stack to be pushed up past the hinged flap.

Where the container 10 is designed to be used in facilities comprising several cubicles having thin partitions between them, the container 10 may be constructed in pairs, each comprising two units positioned back-to-back so that in use one unit extends out to each side of the thin partition.

Alternatively, the container 10 may be arranged to be totally recessed within a wall so that the first aperture 24 is situated in the front wall and the front wall of the container 10 is substantially flush with the wall.

Many other modifications and additional features to the container 10 are also possible without departing from the scope of the present invention as claimed.

We claim:

1. A roll holder and dispenser comprising:

(a) a container having a first aperature through which a roll can be inserted into said container and having a second smaller aperature through which a web of roll material can be withdrawn wherein;

(b) said first aperature comprising the back side of said container, an inward retaining flange on said back side to retain the roll inside said container, hinging means on one side of said container to allow said container to be hinged to a wall allowing said container to swing away from the wall to expose said first aperature and to allow said container to swing back into the wall to block said first aperature, a locking means to keep said container in the closed position;

(c) a roll impeding means for impeding the passage of a roll within said container towards the second aperature; and (d) a roll releasing means whereby a roll can be pushed towards the second aperature against the urging of said impeding means.

* * * * *